United States Patent [19]

Love

[11] 4,375,803

[45] Mar. 8, 1983

[54] VARIABLE FIREPLACE SCREEN AND INSERT

[76] Inventor: Samuel D. Love, 13510 Old Indian Head Rd., Brandywine, Md. 20613

[21] Appl. No.: 256,531

[22] Filed: Apr. 22, 1981

[51] Int. Cl.[3] ..... F24B 7/00

[52] U.S. Cl. ..... 126/121; 126/138; 237/51

[58] Field of Search ..... 126/138, 121, 139, 140, 126/194; 49/25, 207, 369, 367, 380, 505; 237/51

[56] References Cited

U.S. PATENT DOCUMENTS

| | | | |
|---|---|---|---|
| 2,360,611 | 11/1940 | Leonard . | |
| 2,439,503 | 4/1948 | Austin | 126/121 |
| 2,776,707 | 1/1954 | Helwig . | |
| 3,452,803 | 7/1969 | Barnish et al. | 49/367 X |
| 3,601,117 | 8/1971 | Carson . | |
| 3,616,788 | 11/1971 | Hannebaum . | |
| 4,008,704 | 2/1977 | Petrie . | |
| 4,008,707 | 2/1977 | Bartlett . | |
| 4,010,728 | 3/1977 | Hempel et al. . | |
| 4,026,263 | 5/1977 | Boyd . | |
| 4,029,076 | 6/1977 | Simington . | |
| 4,068,650 | 1/1978 | Nelson . | |
| 4,103,670 | 8/1978 | Bergs . | |
| 4,112,915 | 9/1978 | Slavik . | |
| 4,119,081 | 10/1978 | Edwards . | |
| 4,122,824 | 10/1978 | Borgran . | |
| 4,185,612 | 1/1980 | Briner et al. . | |
| 4,217,880 | 8/1980 | Turner, Jr. . | |
| 4,220,131 | 9/1980 | Livezey . | |
| 4,231,349 | 11/1980 | Livesay . | |

*Primary Examiner*—Samuel Scott
*Assistant Examiner*—Randall L. Green
*Attorney, Agent, or Firm*—Stevens, Davis, Miller & Mosher

[57] ABSTRACT

A fireplace screen and insert for increasing the efficiency of conventional fireplaces, useable with a wide variety of fireplace sizes. A frame is defined by two members having horizontally and vertically extending sections, the horizontally extending sections of which are joined by a telescoping sleeve, with vertical legs telescopically extending from the vertical sections of each member. A plurality of door sections of variable heights are provided and are hingedly connected to the frame at a variety of horizontal locations. It is preferred that the frame be provided with air inlet and outlet openings such that a heat exchange system is used. The heat exchange system is advantageously a metal sheet to which is attached a channel of substantially C-shaped cross-section.

5 Claims, 7 Drawing Figures

FIG. 1
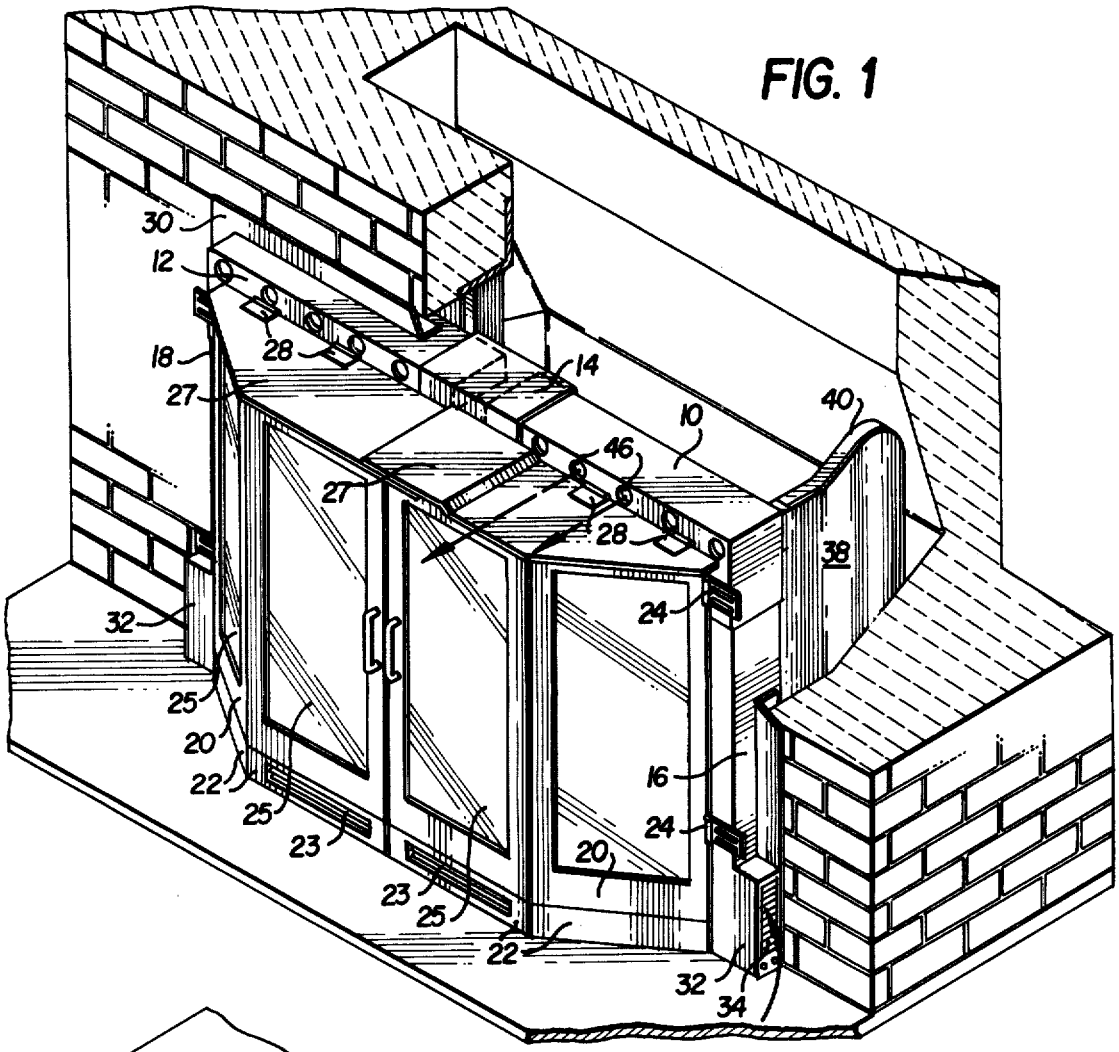
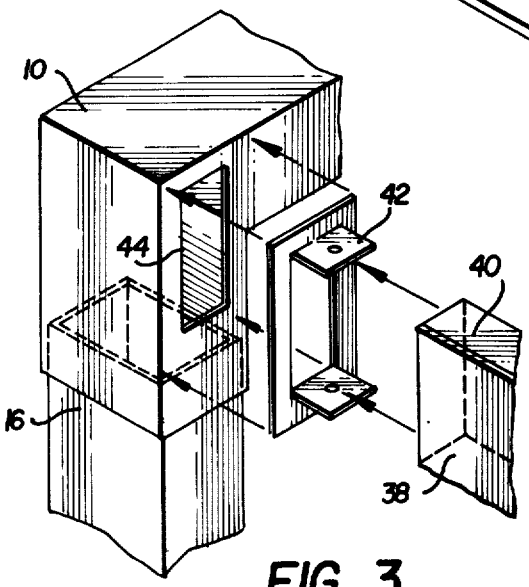
FIG. 3
FIG. 2
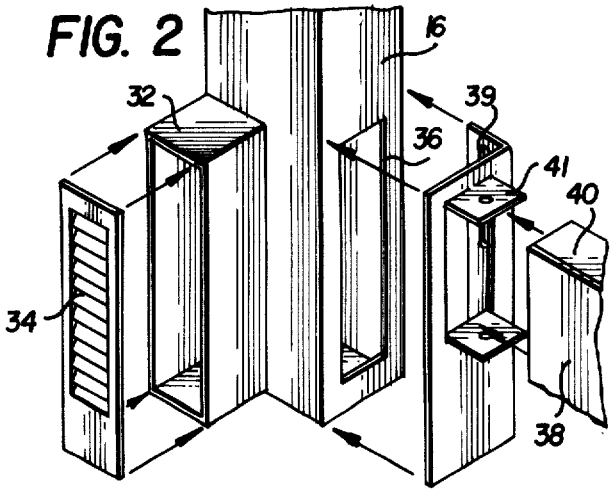

FIG. 4
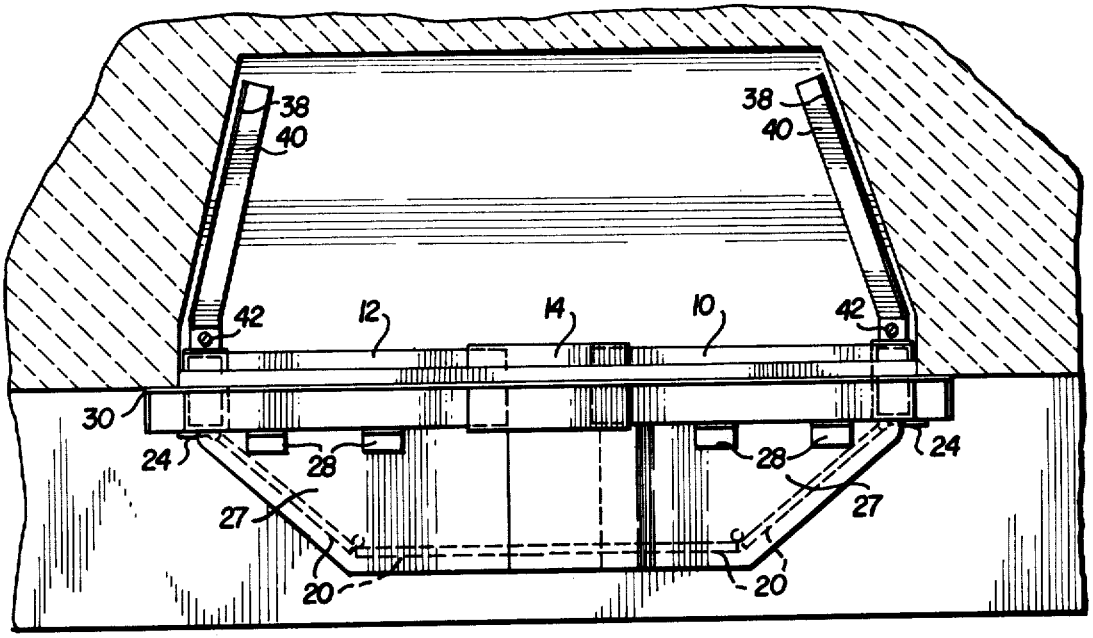
FIG. 5
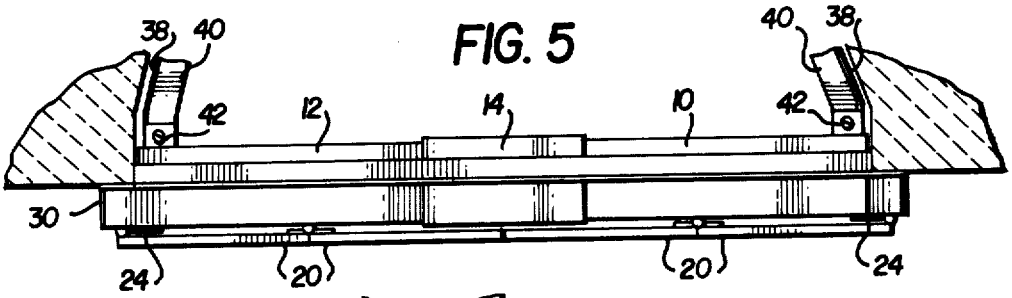
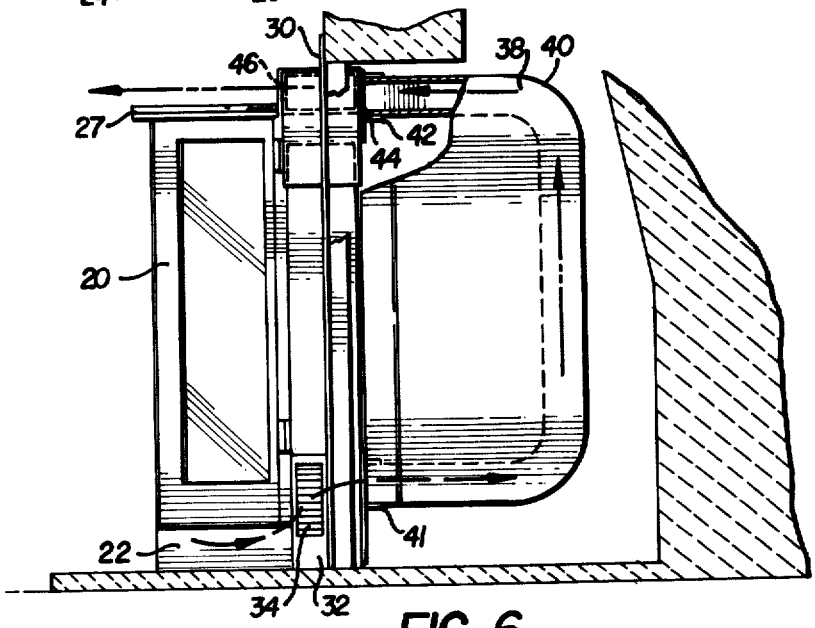
FIG. 6

VARIABLE FIREPLACE SCREEN AND INSERT

BACKGROUND OF THE INVENTION

1. Field of the Invention

This invention relates to fireplace accessories, and more particularly to a combination fireplace screen and insert which improves the heating properties of a fireplace which is useable with a wide range of fireplace sizes.

2. Description of the Prior Art

With recent increases in the prices of fuels such as heating oil and natural gas, a great deal of emphasis has been placed on heating homes by means of wood burning fireplaces. However, as is well known, the use of a fireplace alone can result in the loss of heated air from the house because of the strong draft flowing up the chimney.

In an effort to increase the efficiency of fireplaces, fireplace inserts have been used. These devices generally comprise a rather large metal box which sits partially within the fireplace and extends into the room in which the fireplace is situated. Wood is burned within the large metal box, which has an opening to the chimney. While such inserts have been designed to emote a certain rustic charm, they are not appropriate for use in all situations, for example in a fireplace located in a formal living room. Furthermore, in operation, the large metal box tends to become extremely hot, which can be very hazardous if small children are present.

SUMMARY OF THE INVENTION

It is therefore an object of this invention to provide a device which alleviates the above-mentioned disadvantages of fireplace inserts, while increasing the efficiency of conventional fireplaces.

It is a further object of this invention to provide a device which is useable with a wide variety of fireplace sizes.

It is a still further object of this invention to provide a variable size fireplace screen and insert which may be sold in a kit form and readily assembled by individual consumers.

The above objects and others are obtained by providing a fireplace screen and insert which has two hollow, right angle members, the horizontal sections of which are joined by a sleeve. Hollow leg members are in telescoping relationship to the vertical sections. The right angle members, sleeve and leg members form a frame. A plurality of hinged, height adjustable doors are horizontally variably hinged to the vertical part of the frame. Hinged, overlapping sealing panels are hinged to the horizontal part of the frame, and rest on the top edge of the doors. A peripheral flange is associated with the frame to provide sealing with the fireplace. A heat exchange system is provided, comprising a metal sheet to which a channel of C-shaped cross-section is attached, forming a tube. The hollow legs are provided with air inlets, which are fluidly connected to the tubes (one for each side of the fireplace). The tubes are fluidly connected to the hollow right angle members, which have air outlets to the room.

BRIEF DESCRIPTION OF THE DRAWINGS

FIG. 1 shows a perspective partially sectional view of the fireplace screen and insert of the present invention in place in a fireplace;

FIG. 2 shows an exploded view of some of the duct work of the device of the present invention;

FIG. 3 shows a view of another portion of the duct work of the present invention;

FIG. 4 shows a top view of the fireplace screen and insert of the present invention in place in a fireplace;

FIG. 5 shows a top view of a second embodiment of the present invention;

FIG. 6 shows a side view of the present invention in place in a fireplace; and

DESCRIPTION OF THE PREFERRED EMBODIMENT

Figure 7:
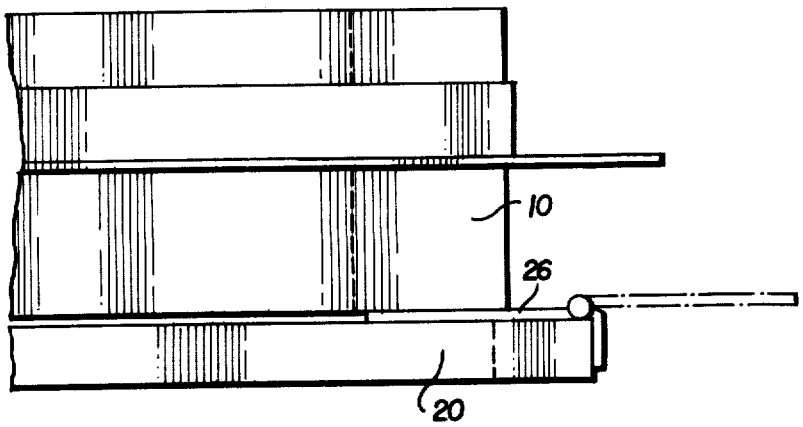
FIG. 7 shows a second method of hinging the doors to the frame of the fireplace screen and insert.

Referring to the drawings, numerals 10 and 12 refer to hollow frame members each having a horizontally extending section and a vertically extending section. The horizontally extending sections of members 10 and 12 are joined by sleeve 14 which is in a telescoping relationship with members 10 and 12. Vertical legs 16 and 18 extend downwardly from the vertical sections of members 10 and 12 respectively. Members 10, 12, 14, 16 and 18 generally define the frame of the fireplace screen and insert and are preferably made of sheet metal. Fireplaces of various widths are provided for by means of the relationship between members 10 and 12 and sleeve 14. Various heights are provided for by having legs 16 and 18 in a telescoping relationship to members 10 and 12.

The device is provided with a plurality of openable door sections 20. The heights of these door sections is adjustable by providing a bottom section 22 which telescopes within the main body of the door. The height adjustability could also be provided by having the bottom section and main body overlap one another. It is also preferred that movable ducts 23 be provided in the door to allow a controlled amount of air to enter the fireplace for combustion purposes. If the fireplace is provided with means for outside combustion air to enter the fireplace, the ducts 23 could be closed or eliminated completely. The present invention is particularly useful for such fireplaces.

The doors may also be provided with a glass section 25 to improve heat transfer and increase the esthetic qualities. The doors are connected to the frame by means of hinges 24, which are provided with slots to provide flexibility in the total horizontal distance encompassed by the doors. It should also be noted that this horizontal flexibility is even greater since the hinges are reversible. That is, the section of the hinge connected to the frame could be laterally flipped so that the hinge face presently shown as facing outwards would contact the frame. This would result in the hinge post being moved away from the center of the fireplace. If this embodiment were shown in FIG. 1, the portion of the hinge connected to the frame would be obscured from view by the door. This can be seen in FIG. 5. Sheet metal screws are preferably used to fasten the hinges to the frame, and also to the doors.

The relationship between the telescoping top and bottom sections of the door is preferably maintained by means of a sheet metal screw and slot system, not specifically shown. As the horizontal distance covered by the doors decreases, the outward extent of the doors from the frame increases. The doors may also be set to extend back into the fireplace rather than out into the room. When the doors extend outwardly, the use of andirons is permitted. Also, the amount of heat transferred to the room is increased since the area exposed to the room is increased.

FIG. 7 shows a second method of hinging the doors to the frame. The hinge 26 of FIG. 7 has one long arm which is connected to the frame and one short arm which is connected to the doors. This hinge is also reversible, so that if the hinge were reversed as shown by the dotted lines of FIG. 7 and then attached to the frame, a smaller horizontal distance could be provided for. The hinge is shown having an offset short arm, providing greater horizontal variability. This decreases the amount of opening. A straight hinge could be used to increase the opening.

The amount of room air entering the fireplace is substantially decreased by the provision of overlapping plates 27, which overlie and rest on the top edges of the doors 20. Horizontal variations are provided for by means of the overlap between the plates. These plates are fixedly hinged (preferably by means of readily assemblable and detachable two piece hinges) to the horizontal section of the frame (the horizontally extending sections of members 10 and 12). These overlapping plates may be omitted, if as shown in FIG. 5, the doors are in a position of full horizontal extension. It is preferred that further sealing is provided between the top edges of the doors and the plates 27, such as a bent piece of spring metal. It would be advantageous to provide a lifting mechanism for plates 27, such as a chain cooperating with a pulley extending from sleeve 14, to allow for raising plates 27 to provide easy access into the fireplace.

The edges of the frame are sealed with respect to the fireplace wall by means of flange 30, which is conveniently a piece of angle metal which can be trimmed to any desired length. It is also preferred that further sealing be accomplished by providing a fiberglass mat between the angle metal piece 30 and the frame. Fiberglass is the preferred material because of its heat and flame resistance and good sealing characteristics. Piece 30 may have any shape so as to accommodate various fireplace configurations, for example, an arched fireplace.

Referring now more specifically to FIGS. 2, 3 and 6, the heat exchange system of the present invention will be described. Legs 16 and 18 are provided with air inlets 32. 34 represents a louvered removeable plate, for controlling the amount of air flowing into the system, attached with screws or resilient flanges for example. If desired, the plate could be removed completely and the outlet of a blower could be attached to the air inlet. The legs are also provided with an air outlet 36. Heat exchange is accomplished by means of metal sheet 38, to which is attached channel 40. The provision of the metal sheet allows for increased heat exchange and also simple manufacture. Channel 40 is connected to air outlet 36 by means of plate 41. It should be noted that outlet 36 is provided with a relatively extended length, to allow for vertical height variations since the height encompassed by channel 40 is fixed. It is contemplated that a ready to assemble kit would come with several different plates 41 having the opening located at different relative heights to allow sealing of outlet 36 for whatever height is desired. Plate 41 preferably has an angular configuration, and is fixed to leg 16 at the desired height by means of the slot 39, which cooperates with a sheet metal screw. Plate 42, having a fixed location and preferably secured by sheet metal screws, provides connection between channel 40 and hollow members 10 and 12. Plates 41 and 42 may be secured to the channel by means of sheet metal screws or any other suitable means. Members 10 and 12 are provided with air inlet 44 to allow access for air from channel 40 into hollow members 10 and 12. Openings 46 allow hot air from channel 40 to enter the room.

It can thus be seen that since the device disclosed provides for heat exchange and for sealing the fireplace against unwanted and unnecessary drafts from the room, the efficiency of the fireplace is greatly increased. This is done, however, without sacrificing the natural beauty of the fireplace. Furthermore, the many variable components allow for use on a wide variety of fireplaces. The components are readily assembled with a relatively small amount of effort and no requirements for special tools.

What is claimed is:

1. A fireplace screen and insert, comprising:

first and second hollow members, each having a horizontally extending section and a vertically extending section;

a sleeve member telescopically disposed between said horizontal sections of said first and second hollow member;

a third hollow member telescopically engaged with said vertically extending section of said first hollow member;

a fourth hollow member telescopically engaged with said vertically extending section of said second hollow member, said first, second, third and fourth hollow members and said sleeve member defining a frame;

a plurality of openably hingedly connected door sections, each door section comprising an upper section and a lower section disposed at a variable height with respect to said upper section; one of said door sections being horizontally variably hinged to a vertical section of said frame, another of said door sections being hinged to the other vertical section of said frame;

first and second overlapping plates, hingedly connected to the horizontal portion of said frame, and overlying the top edges of said door sections; and a flange extending from the periphery of said frame.

2. A fireplace screen and insert, comprising:

a first hollow member having a horizontally extending section, a vertically extending section, an air inlet and an air outlet;

a second hollow member having a horizontally extending section and a vertically extending section;

a sleeve member telescopically disposed between said horizontal sections of said first and second hollow member;

a third hollow member telescopically engaged with said vertically extending section of said first hollow member, having an air inlet and an air outlet;

a fourth hollow member telescopically engaged with said vertically extending section of said second hollow member, said first, second, third and fourth hollow members and said sleeve member defining a frame;

a plurality of openably hingedly connected door sections, each door section comprising an upper section and a lower section telescopically disposed with respect to said upper section; one of said door sections being horizontally variably hinged to a vertical section of said frame, another of said door sections being hinged to the other vertical section of said frame;

first and second overlapping plates, hingedly connected to the horizontal portion of said frame, and overlying the top edges of said door sections; a flange extending from the periphery of said frame; and an air circulation channel fluidly communicating the air outlet opening of said third hollow member with the air inlet opening of said first hollow member.

3. A fireplace screen and insert as claimed in any one of claims 1 or 2, wherein the lower sections of said door sections further comprise variably closeable air ducts.

4. A fireplace screen and insert as claimed in claim 2, wherein said air circulation channel comprises a metal sheet to which a member of substantially C-shaped cross-section is attached.

5. A fireplace screen and insert, comprising:

first and second hollow members each having a horizontally extending section, a vertically extending section, an air inlet opening, and an air outlet hole;

a sleeve member telescopically disposed between said horizontal sections of said first and second hollow member;

a third hollow member telescopically engaged with said vertically extending section of said first hollow member, having an air inlet opening and an air outlet opening;

a fourth hollow member telescopically engaged with said vertically extending section of said second hollow member, having an air inlet opening and air outlet opening, said first, second, third and fourth hollow members and said sleeve member defining a frame;

a plurality of openably hingedly connected door sections, each door section comprising an upper section and a lower section telescopically disposed with respect to said upper section; one of said door sections being horizontally variably hinged to a vertical section of said frame, another of said door sections being horizontally variably hinged to the other vertical section of said frame;

first and second overlapping plates hingedly connected to the horizontal portion of said frame, and overlying the top edges of said door section;

a first sealing member disposed between the top edges of said door sections and said overlapping plates;

a second sealing member disposed along the periphery of said frame;

a flange comprising a piece of angle shaped metal, one leg of which is disposed on said second sealing member;

a first air channel fluidly communicating the air outlet opening of said third hollow member with the air inlet opening of said first hollow member; and a second air channel fluidly communicating the air outlet opening of said fourth hollow member with the air inlet opening of said second hollow member, each of said air channels comprising a metal sheet to which is attached a member of substantially C-shaped cross-section.

* * * * *